US005496028A

United States Patent [19]

Chien

[11] Patent Number: 5,496,028

[45] Date of Patent: Mar. 5, 1996

[54] GOLF CLUB SHAFT WITH TWO FLEX POINTS

[75] Inventor: Jih-Shiao Chien, Taichung Hsien, Taiwan

[73] Assignees: Rapport Composite Co. Ltd., Taipei, Taiwan; Ralph Maltby Ent., Inc., Newark, Ohio

[21] Appl. No.: 380,567

[22] Filed: Jan. 30, 1995

[51] Int. Cl.[6] ..... A63B 53/10

[52] U.S. Cl. ..... 273/80 B; 273/DIG. 23

[58] Field of Search ..... 273/80 R, 80 B, 273/DIG. 7, DIG. 23, 81.6, 81 B, 193 R, 194 B, 187.4, 186.2, 77 R

[56] References Cited

U.S. PATENT DOCUMENTS

| | | | |
|---|---|---|---|
| 1,038,429 | 9/1912 | Penny | 273/80 R |
| 1,418,038 | 5/1922 | Tousey | 273/80 R |
| 1,670,531 | 5/1928 | Cowdery | 273/80 B |
| 1,688,473 | 10/1928 | Sippel | 273/80 B |
| 2,023,131 | 12/1935 | Gibson | 273/80 B |
| 2,250,429 | 7/1941 | Vickery | 273/80 B |
| 4,131,701 | 12/1978 | Vanauken | 273/80 R |
| 4,135,035 | 1/1979 | Branen | 273/80 R |
| 5,251,896 | 10/1993 | Gerlach | 273/80 B |

FOREIGN PATENT DOCUMENTS

| | | | |
|---|---|---|---|
| 800882 | 7/1936 | France | 273/80 R |
| 24769 | 11/1911 | United Kingdom | 273/80 R |
| 404995 | 1/1934 | United Kingdom | 273/80 B |
| 1159714 | 7/1969 | United Kingdom | 273/80 B |
| 2146906 | 5/1985 | United Kingdom | 273/80 B |
| 2250443 | 6/1992 | United Kingdom | 273/80 R |
| 2260499 | 4/1993 | United Kingdom | 273/80 R |
| 8100521 | 3/1981 | WIPO | 273/80 B |

OTHER PUBLICATIONS

"Golf World", magazine, Apr. 12, 1968 issue, Advertisement for First Flight Shafts.

*Primary Examiner*—Sebastiano Passaniti
*Attorney, Agent, or Firm*—Joseph W. Berenato, III

[57] ABSTRACT

A golf club shaft is made of a composite material and includes an upper portion with an enlarged lower end section, and a lower portion with an enlarged upper end section which is adjacent to the enlarged lower end section of the upper portion. The enlarged lower and upper end sections define a contracted section therebetween near the middle portion of the shaft. The upper portion decreases in diameter from the upper end thereof to the upper end of the enlarged lower end section and has a maximum diameter at an axial point which is located on the enlarged lower end section. The upper end of the upper portion is adapted to couple with a grip. The lower portion increases in diameter from the lower end thereof to the lower end of the enlarged upper end section and has a maximum diameter at another axial point which is located on the enlarged upper end section. The lower end of the lower portion is adapted to couple with a club head. Accordingly, two flex points are formed on the shaft, one being located on the contracted section, the other on the lower portion below the enlarged upper end section.

3 Claims, 8 Drawing Sheets

GOLF CLUB SHAFT WITH TWO FLEX POINTS

BACKGROUND OF THE INVENTION

This invention relates to a golf club shaft, more particularly to a shaft which has an adjacent pair of enlarged portions defining a contracted section therebetween so as to form two flex points on the shaft.

It is understood that a golf club shaft can act as a resilient rod which is shown in FIG. 1 and which is fixed on the ground. As illustrated in FIG. 2, when a horizontal force (F) is applied to the top end of the rod 11, a restoration force (R) is created on the top end of the rod 11. Referring to FIG. 3, in a case where the rigidity of the golf club shaft is large such that the flex point of the shaft is located on the lower portion 14 of the shaft, the ball struck by the club flies in the direction indicated by the arrow 15 which forms a larger angle with the ground. In this case, the restoration force of the golf club shaft is small, causing limited flying distance of the ball. In contrast, referring to FIG. 4, in a case where the rigidity of the golf club shaft is small such that the flex point of the shaft is located on the upper portion of 16 the shaft, the ball flies in the direction indicated by the arrow 17 which forms a smaller angle with the ground. In this case, the restoration force of the golf club shaft is too large to easily control movement of the ball, thereby causing the need of better professional skill to swing the shaft. Furthermore, upon striking the ball with the club, the vibration of the club is transferred rapidly to the grip and results in relatively uncomfortable feel of the player.

SUMMARY OF THE INVENTION

An object of this invention is to provide a golf club shaft which has an adjacent pair of enlarged sections near the middle portion of the shaft so as to damp effectively the vibration of the club when striking the ball, thereby reducing largely uncomfortable feel of the player.

Another object of this invention is to provide a golf club shaft which has two flex points so as to easily control the swinging movement of the club.

Still another object of this invention is to provide a golf club shaft which has a lower portion that can create a substantial restoration force when striking the ball.

According to this invention, a golf club shaft is made of a composite material and includes an upper portion with an enlarged lower end section, and a lower portion with an enlarged upper end section which is adjacent to the enlarged lower end section of the upper portion. The enlarged lower and upper end sections define a contracted section therebetween near the middle portion of the shaft. The upper portion decreases in diameter from the upper end thereof to the upper end of the enlarged lower end section and has a maximum diameter at an axial point which is located on the enlarged lower end section. The upper end of the upper portion is adapted to couple with a grip. The lower portion increases in diameter from the lower end thereof to the lower end of the enlarged upper end section and has a maximum diameter at another axial point which is located on the enlarged upper end section. The lower end of the lower portion is adapted to couple with a club head. Accordingly, two flex points are formed on the shaft, one being located on the contracted section, the other on the lower portion below the enlarged upper end section.

In an embodiment, the shaft is tubular and includes:

a first layer reinforced by differential directional carbon fibers and extending along the whole length of the upper portion of the shaft;

a second layer, wrapped around the first layer, extending-.from the first layer to an intermediate portion of the lower portion of the shaft, reinforced by carbon fibers which form a small angle with the axis of the shaft at the upper portion of the shaft and which form a large angle with the axis of the shaft at the contracted section and the lower portion of the shaft, the large angle being larger than the small angle;

a third layer, wrapped around the second layer, having an upper end located on the contracted section of the shaft, extending from the contracted section of the shaft to the lower portion of the shaft, reinforced by carbon fibers which form an angle of about 45 degrees with the axis of the shaft; and a coating layer having an upper section wrapped around the second layer, a lower section wrapped around the third layer and extending along the whole length of the shaft.

The contracted section may be spaced apart from the head at a distance of 44 to 57% of the whole length of the shaft so as to gain a best vibration-absorbing effect, or of 41 to 50% of the whole length of the shaft so as to gain a greatest restoration force.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 5:
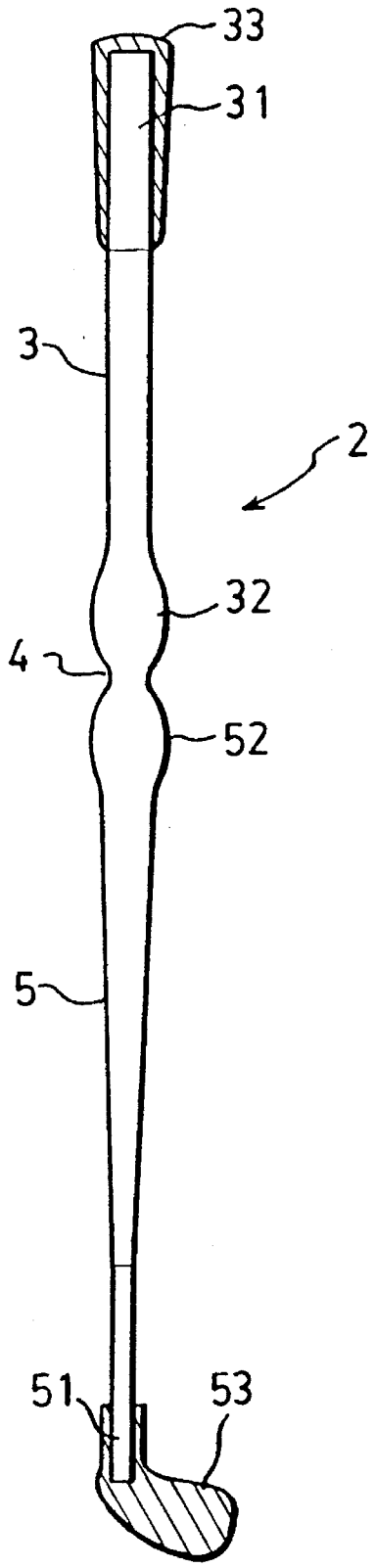
FIG. 5 illustrates the structure of a golf club shaft according to this invention.

Referring to FIG. 5, a golf club shaft 2 is made of a composite material and includes an upper portion 3 with an enlarged lower end section 32, and a lower portion 5 with an enlarged upper end section 52 which is adjacent to the enlarged lower end section 32 of the upper portion 3. The enlarged lower and upper end sections 32, 52 define a contracted section 4 therebetween near the middle portion of the shaft 2. The upper portion 3 decreases in diameter from the upper end 31 thereof to the upper end of the enlarged lower end section 32 and has a maximum diameter at an axial point which is located on the enlarged lower end section 32. The upper end 31 of the upper portion 3 is adapted to couple with a grip 33. The lower portion 5 increases in diameter from the lower end 51 thereof to the lower end of the enlarged upper end section 52 and has a maximum diameter at another axial point which is located on the enlarged upper end section 52. The lower end 51 of the lower portion 5 is adapted to couple with a club head 53.

Figure 6:
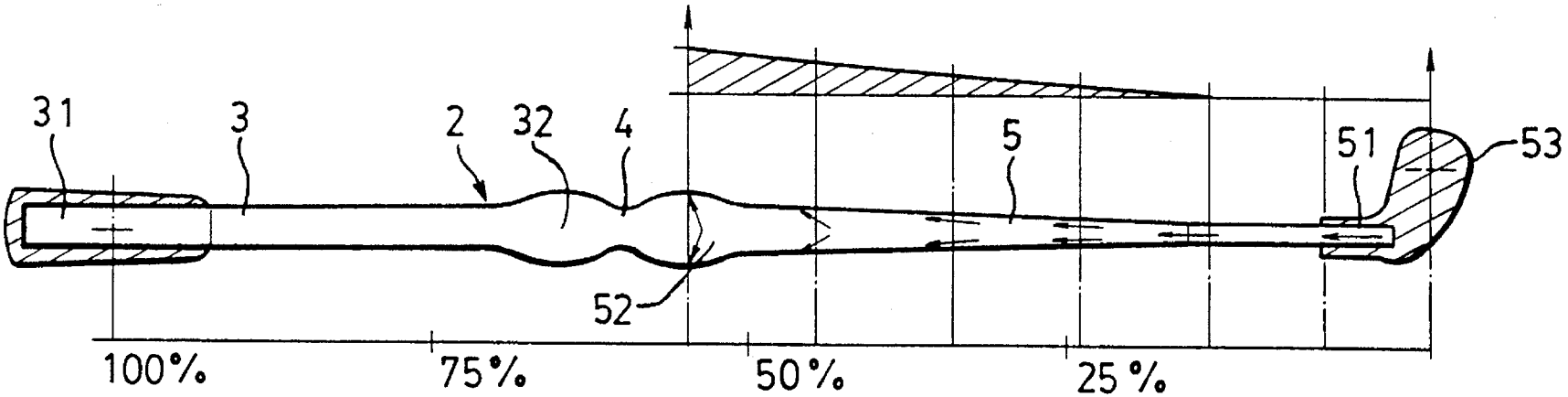
FIG. 6 illustrates the advance of the vibratory wave in the golf club shaft in accordance with this invention.

As illustrated in FIG. 6, wherein the horizontal axis represents the advance distance of the vibratory wave from the ball striking point of the club head, while the longitudinal axis represents the angle formed between the direction of the wave front and the axis of the shaft, in the lower portion 5 of the shaft 2, the directions of the vibratory waves are indicated by the arrows. The majority of the vibratory waves are dampened in the area in which the enlarged lower and upper end sections 32, 52 are located and in which the angles formed between the axis of the shaft and the directions of the wave fronts are quite large.

Figure 7:
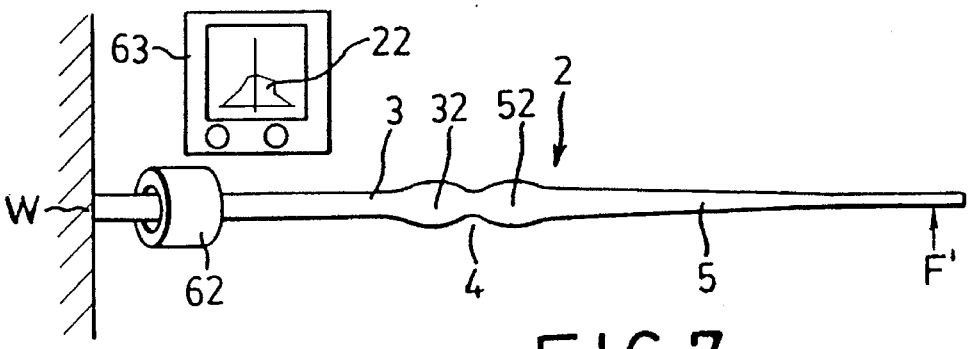
FIG. 7 illustrates the wave form of the vibratory wave in a cross-section of the upper portion of the golf club shaft according to this invention.
Figure 8:
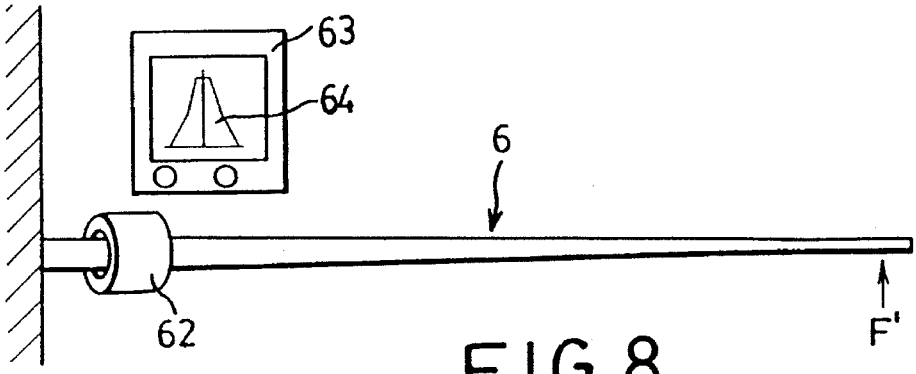
FIG. 8 illustrates the wave form of the vibratory wave in a cross-section of the upper portion of the conventional golf club shaft.

Referring to FIG. 7, in a test, the shaft 2 is fixed on a vertical wall (W) and located at a horizontal position, in such a manner that an electromagnetic sensor 62 is sleeved on an upper end portion of the upper portion 3 of the shaft 2. When a vertical force (F') is applied to the free end of the shaft 2, the sensor 62 sends out a signal so as to indicate on a display 63 a wave form 22 of the vibratory wave in a cross section of the upper portion 3 on which the sensor 62 is located. In comparison with the prior art shaft tested by the same equipment, the wave form 22 of this invention is smaller than the wave form 64 (see FIG. 8) of a conventional shaft 6 (see FIG. 8). Accordingly, when striking a ball, the vibratory absorbing effect of the enlarged lower and upper end sections 32, 52 reduces largely uncomfortable gripping feel of the player.

Figure 9:
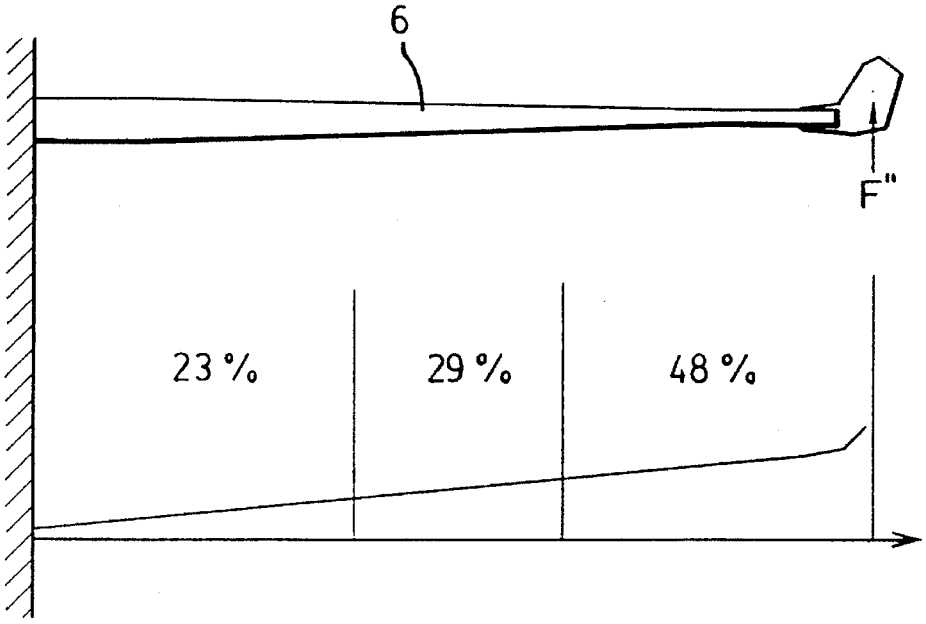
FIG. 9 illustrates the distribution of the strain energy in the conventional golf club shaft when striking a ball.
Figure 10:
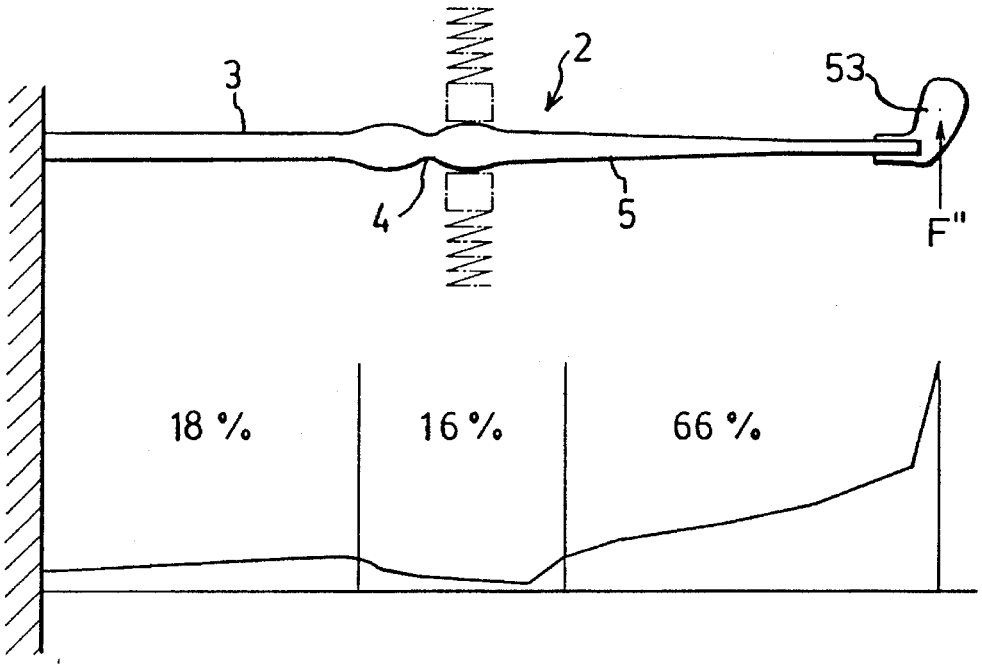
FIG. 10 illustrates the distribution of the strain energy in the golf club shaft according to this invention.

FIG. 9 illustrates the distribution of the strain energy in the conventional golf club shaft 6 when striking a ball by a force (F"). As illustrated, the average strain energy values of the upper, middle and lower portions of the shaft 6 are 23%, 29% and 48%. In contrast, as shown in FIG. 10, the average strain energy values of the upper, middle and lower portions of the shaft 2 according to this invention are 18%, 16% and 66%. As a result, the strain energy of the shaft 2 according to this invention is large enough to offer a more satisfactory restoration force of the shaft 2, as compared to the prior art shaft 6 of FIG. 9.

Figure 1:
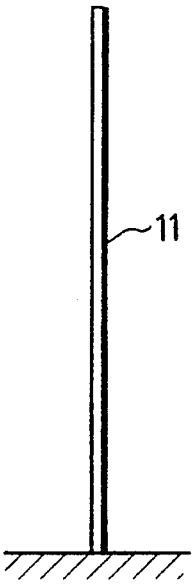
FIGS. 1 and 2 illustrate the swinging movement of a vertical rod, simulating that of a conventional golf club shaft.
Figure 2:
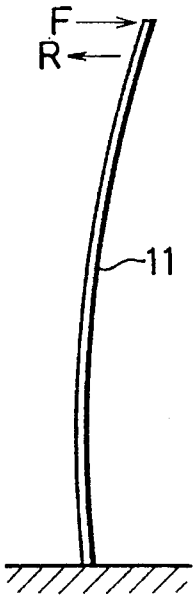
Figure 3:
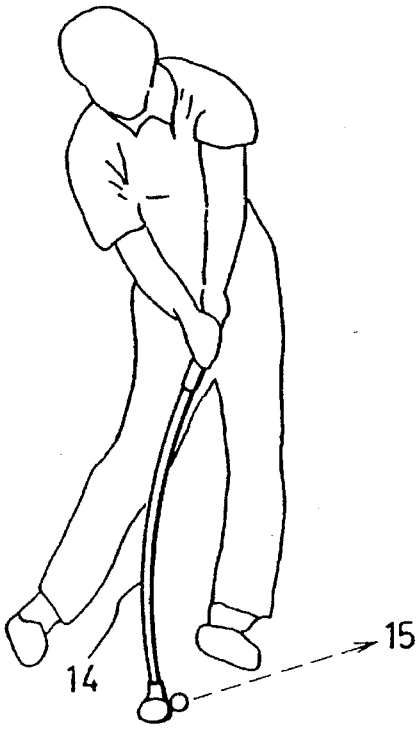
FIGS. 3 and 4 illustrate the flex of the conventional golf club shaft.
Figure 4:
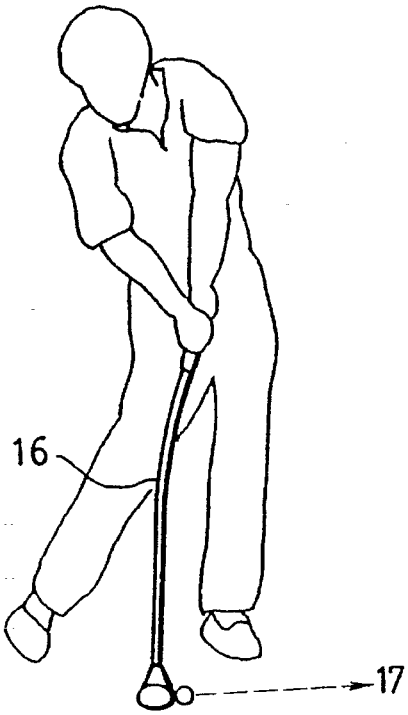
Figure 11:
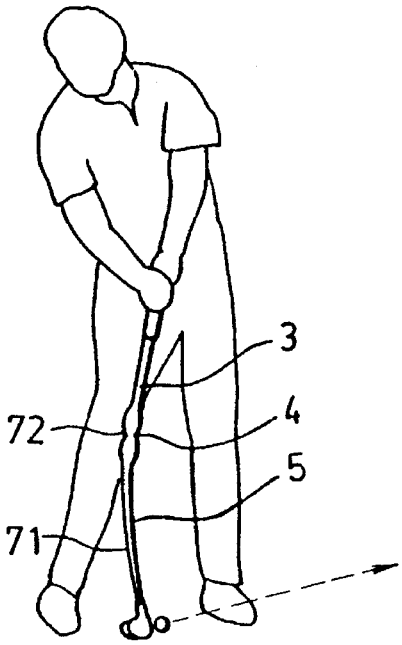
FIG. 11 illustrates two flex points of the golf club shaft according to this invention.

As illustrated in FIG. 11, when swinging the shaft of this invention, a lower flex point 71 is formed on the lower portion 5 of the shaft, while a upper flex point 72 on the contracted section 4. In this way, the controllability of the club is better than the prior art shaft shown in FIG. 4.

Figure 12:
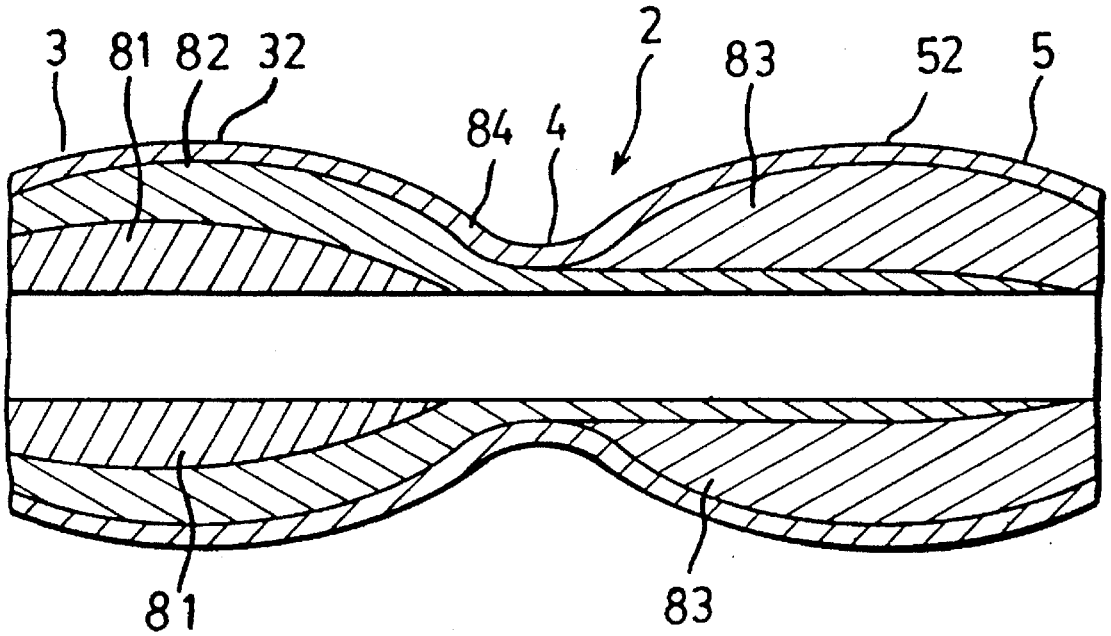
FIG. 12 is a longitudinal sectional view illustrating the layers of the carbon-fiber reinforced composite material of the golf club shaft according to this invention.
Figure 13:
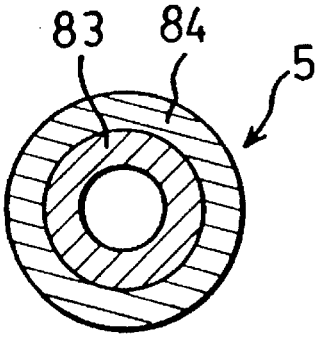
FIG. 13 is a cross sectional view illustrating the layers of the carbon-fiber reinforced composite material of the golf club shaft according to this invention.

FIG. 12 illustrates the interior structure of enlarged lower and upper end sections 32, 52. FIG. 13 illustrates the interior structure of a cross section of the lower end portion 5 of the shaft. In manufacture of the shaft 2, four layers of carbon-fiber reinforced composite material are wrapped around a base rod (not shown). Then, the base rod is withdrawn from the wrapped layers so as to form a tubular construction. As illustrated, a first layer 81 is reinforced by differential directional carbon fibers and extends along the whole length of the upper portion of the shaft 2. A second layer 82 is wrapped around the first layer 81 and extends from the first layer 81 to an intermediate portion of the lower portion 5 of the shaft 2. The carbon fibers of the second layer 82 form a small angle with the axis of the shaft 2 at the upper portion 3 of the shaft 2 and form a large angle with the axis of the shaft 2 at the contracted section 4 and the lower portion 5 of the shaft. A third layer 83 is wrapped around the second layer 82 and has an upper end located on the contracted section 4 of the shaft 2. The lower portion of the third layer 83 extends to the lower end of the shaft. The carbon fibers of the third layer 83 form an angle of about 45 degrees with the axis of the shaft 2 so as to provide a larger restoration force to the lower portion 5 of the shaft 2. A coating layer 84 has an upper section wrapped around the second layer 82, and a lower section wrapped around the third layer 83 and extends along the whole length of the shaft 2.

Figure 14A:
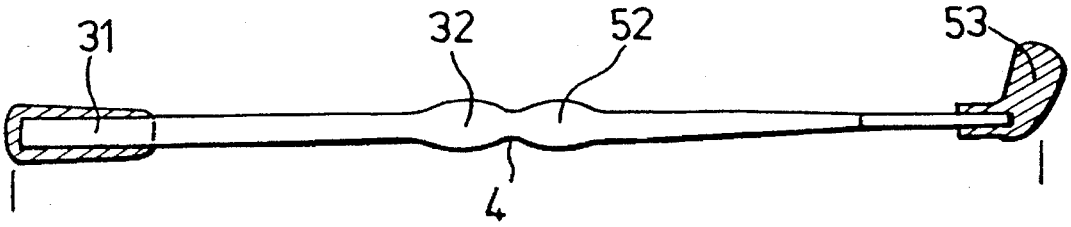
FIG. 14A illustrates the position of the contracted section of the golf club shaft of this invention, which has a best vibration absorbing effect.
Figure 14B:
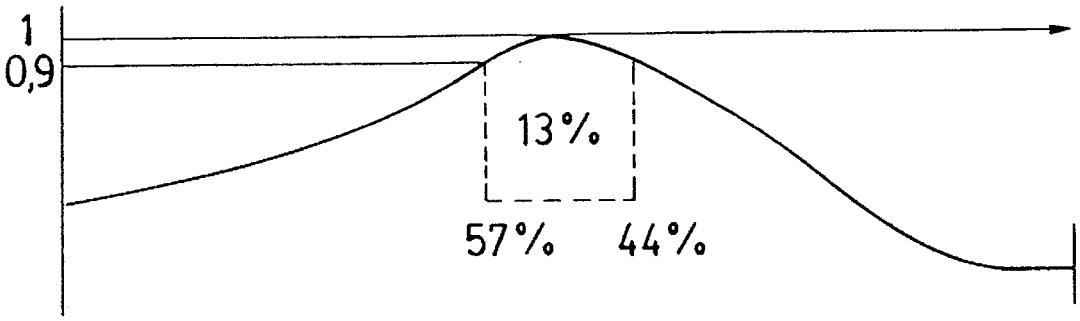
FIG. 14B illustrates the distribution of the vibration absorbing effect in the golf club shaft of FIG. 14A.
Figure 15A:
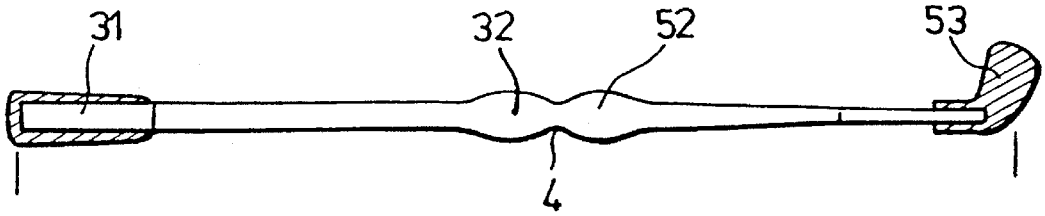
FIG. 15A illustrates the position of the contracted section of the golf club shaft of this invention, which has a greatest restoration force.
Figure 15B:
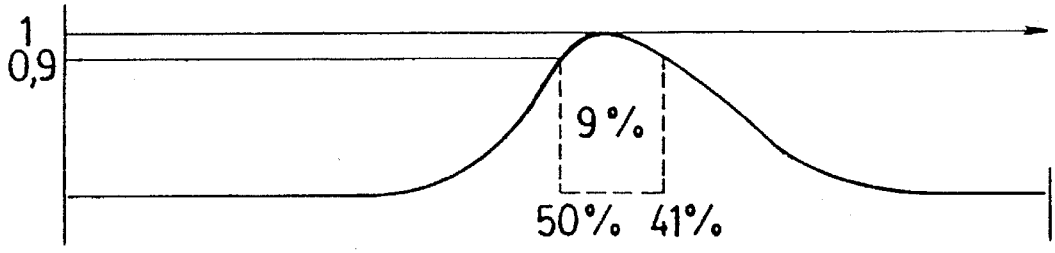
FIG. 15B illustrates the distribution of the restoration force in the golf club shaft of FIG. 15A.

According to an experiment, the contracted section 4 may be spaced apart from the head 51 at a distance of 44 to 57% (see FIGS. 14A and 14B) of the whole length of the shaft 2 so as to gain a best vibration-absorbing effect, or of 41 to 50% (see FIGS. 15A and 15B) of whole length of the shaft so as to gain a greatest restoration force.

With this invention thus explained, it is apparent that numerous modifications and variations can be made without departing from the scope and spirit of this invention. It is therefore intended that this invention be limited only as indicated in the appended claims.

I claim:

1. A golf club shaft made of a composite material and comprising an upper portion with an enlarged lower end section, and a lower portion with an enlarged upper end section which is adjacent to said enlarged lower end section of said upper portion, said enlarged lower and upper end sections defining a contracted section therebetween near a middle portion of said shaft, said upper portion decreasing in diameter from an upper end thereof to an upper end of said enlarged lower end section and having a maximum diameter at an axial point which is located on said enlarged lower end section, an upper end of said upper portion being adapted to couple with a grip, said lower portion increasing in diameter from a lower end thereof to a lower end of said enlarged upper end section and having a maximum diameter at another axial point which is located on said enlarged upper end section, the lower end of said lower portion being adapted to couple with a club head, and wherein said shaft is tubular and includes a first layer reinforced by differential directional carbon fibers and extending the whole length of said upper portion of said shaft, a second layer wrapped around said first layer, extending from said first layer to an intermediate portion of said lower portion of said shaft, reinforced by carbon fibers which form a small angle with the axis of said shaft at said upper portion of said shaft and which form a large angle with the axis of said shaft at said contracted section and said lower portion of said shaft, said large angle being larger than said small angle, a third layer wrapped around said second layer, having an upper end located on said contracted section of said shaft, extending from said contracted section of said shaft to said lower portion of said shaft, reinforced by carbon fibers which form an angle of about 45° with the axis of said shaft, a coating layer having an upper section wrapped around said second layer and a lower section wrapped around said third layer and extending along the whole length of said shaft, whereby two flex points are formed on the shaft, one flex point being located on said contracted section and the other flex point on said lower portion below said enlarged end section.

2. A golf club shaft made of a composite material and comprising an upper portion with an enlarged lower end section, and a lower portion with an enlarged upper end section which is adjacent to said enlarged lower end section of said upper portion, said enlarged lower and upper end sections defining a contracted section therebetween near a middle portion of said shaft, said upper portion decreasing in diameter from an upper end thereof to an upper end of said enlarged lower end section and having a maximum diameter at an axial point which is located on said enlarged lower end section, the upper end of said upper portion being adapted to couple with a grip, said lower portion increasing in diameter from a lower end thereof to a lower end of said enlarged upper end section and having a maximum diameter at another axial point which is located on said enlarged upper end section, the lower end of said lower portion being adapted to couple with a club head, whereby, two flex points are formed on the shaft, one being located on said contracted section, the other on said lower portion below said enlarged end section; and wherein said contracted section is spaced apart from the head at a distance of 44 to 57% of the whole length of said shaft, so as to gain a best vibration-absorbing effect.

3. A golf club shaft made of a composite material and comprising an upper portion with an enlarged lower end section, and a lower portion with an enlarged upper end section which is adjacent to said enlarged lower end section of said upper portion, said enlarged lower and upper end sections defining a contracted section therebetween near a middle portion of said shaft, said upper portion decreasing in diameter from an upper end thereof to an upper end of said enlarged lower end section and having a maximum diameter at an axial point which is located on said enlarged lower end section, the upper end of said upper portion being adapted to couple with a grip, said lower portion increasing in diameter from a lower end thereof to a lower end of said enlarged upper end section and having a maximum diameter at another axial point which is located on said enlarged upper end section, the lower end of said lower portion being adapted to couple with a club head, whereby, two flex points are formed on the shaft, one being located on said contracted section, the other on said lower portion below said enlarged end section; and wherein said contracted section is spaced apart from the head at a distance of 41 to 50% of the whole length of said shaft, so as to gain a greatest restoration force.

* * * * *